US010160245B2

(12) United States Patent
Horn

(10) Patent No.: US 10,160,245 B2
(45) Date of Patent: Dec. 25, 2018

(54) HEAT-SENSITIVE RECORDING MATERIAL

(71) Applicant: Papierfabrik August Koehler SE, Oberkirch (DE)

(72) Inventor: Michael Horn, Offenburg (DE)

(73) Assignee: Papierfabrik August Kohler SE, Oberkirch (DE)

( * ) Notice: Subject to any disclaimer, the term of this patent is extended or adjusted under 35 U.S.C. 154(b) by 0 days.

(21) Appl. No.: 15/312,754

(22) PCT Filed: May 28, 2015

(86) PCT No.: PCT/EP2015/061835
§ 371 (c)(1),
(2) Date: Nov. 21, 2016

(87) PCT Pub. No.: WO2015/181291
PCT Pub. Date: Dec. 3, 2015

(65) Prior Publication Data

US 2017/0190199 A1 Jul. 6, 2017

(30) Foreign Application Priority Data

May 28, 2014 (DE) ..... 10 2014 107 567

(51) Int. Cl.

| | |
|---|---|
| ***B41M 5/337*** | (2006.01) |
| ***B41M 5/333*** | (2006.01) |
| ***B41M 5/327*** | (2006.01) |
| ***B05D 1/30*** | (2006.01) |
| *B41M 5/323* | (2006.01) |

(52) U.S. Cl.
CPC ..... *B41M 5/3333* (2013.01); *B05D 1/305* (2013.01); *B41M 5/3275* (2013.01); *B41M 5/3375* (2013.01); *B41M 5/323* (2013.01)

(58) Field of Classification Search
CPC .... B41M 5/323; B41M 5/327; B41M 5/3275; B41M 5/333; B41M 5/3336; B41M 5/337; B41M 5/3375; B05D 1/30; B05D 1/305
USPC ..... 503/209, 216, 217, 220, 221, 224, 200
See application file for complete search history.

(56) References Cited

U.S. PATENT DOCUMENTS

| | | | |
|---|---|---|---|
| 6,548,120 | B1 | 4/2003 | Wittosch et al. |
| 7,976,904 | B2 | 7/2011 | Barcock et al. |
| 2002/0155951 | A1 | 10/2002 | Shuku et al. |
| 2003/0188839 | A1 | 10/2003 | Urscheler |
| 2008/0269047 | A1 | 10/2008 | Boschert et al. |
| 2009/0130323 | A1 † | 5/2009 | Elsner |
| 2015/0284321 | A1 † | 10/2015 | Sakai |
| 2015/0367663 | A1 † | 12/2015 | Yamane |
| 2016/0082760 | A1 † | 3/2016 | Takano |
| 2016/0332469 | A1 | 11/2016 | Morita |

FOREIGN PATENT DOCUMENTS

| | | | |
|---|---|---|---|
| AT | 395 617 | B | 2/1993 |
| DE | 10196052 | T1 | 2/2003 |
| DE | 695 31 658 | T2 | 6/2004 |
| DE | 60200762 | T2 | 8/2005 |
| DE | 102004029261 | A1 | 1/2006 |
| DE | WO2008/025479 | A2 | 3/2008 |
| EP | 0620122 | B1 | 3/1996 |
| EP | 1535748 | A1 | 6/2005 |
| EP | 3053753 | A1 | 10/2016 |
| JP | 2012-504442 | | 11/2012 |
| JP | WO2014/080615 | A1 | 5/2014 |
| JP | WO2014/126018 | A1 | 8/2014 |
| JP | WO2014189044 | A1 | 11/2014 |
| JP | WO2015/111518 | A1 | 7/2015 |
| WO | WO0026037 | A1 | 5/2000 |
| WO | 02/084029 | A2 † | 10/2002 |
| WO | WO02/084029 | A2 | 10/2002 |
| WO | WO2014080615 | A1 | 5/2014 |

(Continued)

OTHER PUBLICATIONS

Dr. Jobst Wibbelmann, Wuesthoff & Wuesthoff, Notice of Opposition dated Jul. 22, 2016 against German patent 10 2014 107 567 B3 with computer generated Google Translation in English.
Manuel Soldenwagner, Eisenfuhr Speiser, Notice of Opposition dated Aug. 5, 2016 against German patent 10 2014 107 567.6 with computer generated Google Translation in English.
Sangl, Reinhard, Curtain Coating in the Paper Industry—an Update, Magazine called "Coating", pp. 9-15, Jun. 2010.
Eisenfuhr Speiser, Letter to German Patent Office on behalf of Mitsubish HiTec Paper Europe GmbH in opposition to German Patent 10 2014 107 567.6, 7 pages, Oct. 5, 2017.
International Search Report with English Translation for corresponding International Application No. PCT/EP2015/061835, dated Aug. 24, 2015.

(Continued)

*Primary Examiner* — Bruce H Hess
(74) *Attorney, Agent, or Firm* — Cook Alex Ltd.

(57) ABSTRACT

The invention relates to a heat-sensitive recording material. A heat-sensitive recording material, comprising a carrier substrate and a heat-sensitive, color-forming layer that contains at least one color former and at least one phenol-free color developer, is characterized in that said at least one color developer is a compound of formula (I) where $Ar_1$ and $Ar_2$ are a phenyl group and/or a $C_1$-$C_4$-alkyl substituted phenyl group. The invention also relates to a method for producing this heat-sensitive recording material and to the use, in a heat-sensitive recording material, of the color developer of formula (I) that is present in said heat-sensitive, color-forming layer.

(I)

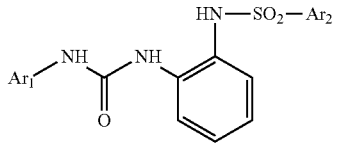

20 Claims, No Drawings

(56) References Cited

FOREIGN PATENT DOCUMENTS

| | | | |
|---|---|---|---|
| WO | WO2014126018 | A1 | 8/2014 |
| WO | WO2014189044 | A1 | 11/2014 |

OTHER PUBLICATIONS

Article from Magazine "twogether", together with an English translation of the text passages quoted in the statement of opposition, Dec. 2010.
Voith Publication of "One step ahead with innovations from Voith Paper", Bled, Nov. 24, 2011.
Sakai, et al., Recording Material Produced Using Non-Phenol Compound, Publication No. 2012-504442, Nov. 22, 2012.
Sakai, et al., Recording Material Produced Using Non-Phenol Compound, English Translation.
Excerpt of Handbook of Paper and Board, Second, Revised and Enlarged Edition, vol. 1, together with an excerpt of the Amazon publication date Apr. 23, 2013.
Statement of Opposition against German Pat. No. 10 2014 107 567 with translation, Oct. 16, 2017.
Revocation Decision from German Patent and Trademark Office regarding Pat. No. 10 2014 107 567 with translation, Oct. 19, 2017.
Publication No. 2012-504442, Recording Material Produced Using Non-Phenol Compound, Hatsumei Suishin Kyokai Kokai Giho (Journal of Technical Disclosure), Nov. 22, 2012, Japan Institute for Promoting Invention and Innovation.†

† cited by third party

HEAT-SENSITIVE RECORDING MATERIAL

CROSS-REFREENCE TO RELATED APPLICATIONS

This is a U.S. national stage application of International Patent Application No. PCT/EP2015/061835, filed May 28, 2015, which claims the benefit of and priority to German Patent Application No. 102014107567.6, filed May 28, 2014, both of which are incorporated herein by reference.

DESCRIPTION

The invention relates to a heat-sensitive recording material, comprising a carrier substrate and a heat-sensitive colour-forming layer containing at least one colour former and at least one phenol-free colour developer, to a method for its production and to the use of the phenol-free colour developer contained in the heat-sensitive recording material.

Heat-sensitive recording materials for application in direct thermal printing, which materials have a heat-sensitive colour-forming layer (thermal reaction layer) applied to a carrier substrate, have been known for a long time. In the heat-sensitive colour-forming layer there are usually present a colour former and a colour developer which react with one another under the action of heat and thus result in the development of a colour. Also known are heat-sensitive recording materials that contain a non-phenolic colour developer in the heat-sensitive colour-forming layer. Those materials have been developed in order to improve the stability of the printed image, especially when the printed heat-sensitive recording material is stored for a prolonged period or comes into contact with hydrophobic substances, such as plasticiser-containing materials or oils. Particularly in the light of public discussion relating to the potential toxicity of (bis)phenolic chemicals, interest in non-phenolic colour developers has sharply increased, the objective being to avoid the disadvantages of phenolic colour developers, while at least retaining the performance properties that can be achieved with phenolic colour developers.

EP 0 620 122 B1 discloses non-phenolic colour developers from the class of aromatic sulphonylureas. Those colour developers can be used to obtain heat-sensitive recording materials that are distinguished by a high image stability. Furthermore, the heat-sensitive recording materials based on those colour developers exhibit serviceable thermal sensitivity with good surface-whiteness, so that with a suitably formulated heat-sensitive colour-forming layer it is comparatively easy to generate high print densities using commercially available thermal printers. In practice, primarily 4,4'-bis-(p-tolylsulphonylureido)-diphenylmethane (B-TUM) and N'-(p-toluenesulphonyl)-N'-phenylurea (TUPH) have become established.

WO 0 035 679 A1 discloses aromatic and heteroaromatic sulphonyl(thio)urea compounds (X=S or O) and; or sulphonyl guanidines (X=NH) of the formula $$Ar'—SO_2—NH—X—NH—Ar,$$

wherein Ar is linked by a divalent linker group to further aromatic groups. A non-phenolic developer of this class that is widely used in practice, N-(p-tolylsulphonyl)-N'-(3-p-tolylsulphonyloxy-pheny)urea (commercial name Pergafast 201®, PF201 BASF) is distinguished by the balance of the application-related properties of the heat-sensitive recording materials prepared therewith. In particular, they exhibit good dynamic responsiveness and high stability of the print-out towards hydrophobic substances.

As regards the durability aspect, in the case of heat-sensitive recording materials particular importance is attached to the following factors:

a) The stability of the unprinted ("white") heat-sensitive recording material during prolonged storage and/or under adverse climatic conditions, especially in respect of the maintenance of the specified values of dynamic responsiveness and whiteness, and b) the stability of the printed image generated by the thermal printing, which should especially withstand the (even prolonged) action of temperature, atmospheric oxygen, light, moisture, hydrophobic agents etc. (archivability).

While the requirements mentioned under a) relate to the stability or constancy of the composition of the heat-sensitive colour-forming layer, especially the chemical stability of the colour-forming components, even on prolonged storage and under adverse climatic conditions, the requirements mentioned under b) are targeted at the stability of the colour complex formed in the heat-sensitive colour-forming layer during the printing process.

Although the above-mentioned heat-sensitive recording materials with colour developers based on sulphonylureas fulfil the requirements mentioned under b), they exhibit weaknesses in respect of the requirements listed under a). That is the case because the sulphonylureas are chemically unstable, especially in the presence of water. The tendency of sulphonylureas to decompose over a wide pH range is known and well documented (A. K. Sarmah, J. Sabadie, J. Agric. Food Chem., 50, 6253 (2002)).

The problem of the present invention is therefore to eliminate the disadvantages of the prior art described above. In particular, the problem of the present invention is to provide a heat-sensitive recording material which also fulfils the requirements mentioned above under a), that is to say the functional properties required by the application, such as thermal responsiveness and surface-whiteness, including during storage for prolonged periods and under adverse climatic conditions. The problem accordingly relates to the property profile of an unprinted heat-sensitive recording material.

According to the invention, that problem is solved with a heat-sensitive recording material according to claim 1, according to which the material comprises a carrier substrate and a heat-sensitive colour-forming layer containing at least one colour former and at least one phenol-free colour developer and is characterised in that the at least one colour developer is a compound of the formula (I)

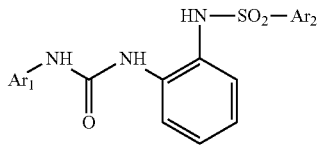

(I)

wherein $Ar_1$ and $Ar_2$ are a phenyl radical and/or a $C_1$-$C_4$alkyl-substituted phenyl radical.

Between the carrier substrate and the heat-sensitive layer there is optionally present at least one further intermediate layer. There can also be present at least one protective layer and/or at least one layer that promotes printability in the heat-sensitive recording material according to the invention.

The $C_1$-$C_4$alkyl-substituted phenyl radical is preferably a $C_1$alkyl-substituted phenyl radical (ortho-, meta- and/or para-substituted), especially a para-substituted $C_1$alkyl-substituted phenyl radical. Special preference is given to a methyl radical; very special preference is given to a para-methyl radical.

In an especially preferred embodiment, $Ar_1$ and $Ar_2$ are a para-methyl-substituted phenyl radical.

In a further especially preferred embodiment, $Ar_1$ is a phenyl radical and $Ar_2$ is a para-methyl-substituted phenyl radical.

In a very especially preferred embodiment, $Ar_1$ and $Ar_2$ are each a phenyl radical, that is to say the at least one colour developer is N-(2-(3-phenylureido)phenyl)-benzenesulphonamide.

Preferably from approximately 0.5 to approximately 10 parts by weight, especially from approximately 1.5 to approximately 4 parts by weight, of the compound of the formula (I) are present, based on the colour former. Amounts of less than 0.5 part by weight have the disadvantage that the desired thermal print sensitivity is not achieved, while amounts of more than 10 parts by weight have the result that the cost-effectiveness of the recording material suffers, without any application-related improvements being achievable.

The compound of the formula (I) is preferably present in an amount of from approximately 3 to approximately 35% by weight, especially preferably in an amount of from approximately 10 to approximately 25% by weight, based on the total solids content of the heat-sensitive layer.

The selection of the carrier substrate is not critical. However, it is preferable to use as carrier substrate paper, synthetic paper and/or a plastics film.

As regards the choice of colour former, the present invention is likewise not subject to any appreciable limitations. Preferably, however, the colour former is a dye of the triphenylmethane type, of the fluoran type, of the azaphthalide type and/or of the fluorene type. A very especially preferred colour former is a dye of the fluoran type, because by virtue of its availability and its balanced application-related properties, it enables a recording material having an attractive price/performance ratio to be provided.

Especially preferred dyes of the fluoran type are:

3-diethylamino-6-methyl-7-anilinofluoran,
3-(N-ethyl-N-p-toludinamino)-6-methyl-7-anilinofluoran,
3-(N-ethyl-N-isoamylamino)-6-methyl-7-anilinofluoran,
3-diethylamino-6-methyl-7-(o,p-dimethylanilino)fluoran,
3-pyrrolidino-6-methyl-7-anilinofluoran,
3-(cyclohexyl-N-methylamino)-6-methyl-7-anilinofluoran,
3-diethylamine-7-(m-trifluoromethylanilino)fluoran,
3-N-n-dibutylamine-6-methyl-7-anilinofluoran,
3-diethylamino-6-methyl-7-(m-methylanilino)fluoran,
3-N-n-dibutylamine-7-(o-chloroanilino)fluoran,
3-(N-ethyl-N-tetrahydrofurfurylamine)-6-methyl-7-anilinofluoran,
3-(N-methyl-N-propylamine)-6-methyl-7-anilinofluoran,
3-(N-ethyl-N-ethoxypropylamine)-6-methyl-7-anilinofluoran,
3-(N-ethyl-N-isobutylamine)-6-methyl-7-anilinofluoran and/or
3-dipentylamine-6-methyl-7-anilinofluoran.

In an especially preferred embodiment, in addition to the colour developer of the compound of the formula (I), one or more further non-phenolic colour developers are present in the heat-sensitive colour-forming layer.

The one or more further non-phenolic colour developers are preferably N'-(p-toluenesulphonyl)-N'-phenylurea, N-(p-toluenesulphonyl)-N'-3-(p-toluenesulphonyl-oxyphenyl)-urea and/or 4,4'-bis-(p-tolylsulphonylureido)-diphenylmethane.

In an especially preferred embodiment, the heat-sensitive recording material according to the invention is a heat-sensitive recording material, comprising a carrier substrate and also a heat-sensitive colour-forming layer containing at least one colour former, at least one phenol-free colour developer and at least one sensitising agent, characterised in that the at least one colour developer is a compound of the formula (I)

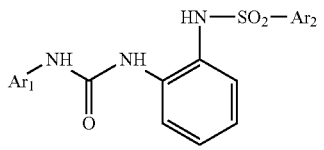

(I)

wherein $Ar_1$ and $Ar_2$ are a phenyl radical and/or a $C_1$alkyl-substituted phenyl radical, the heat-sensitive recording materials 42 and 43 of WO 2014/080615 being excluded, wherein the carrier substrate is paper, synthetic paper and/or a plastics film, and wherein the at least one colour former is a dye of the fluoran type.

In addition to the at least one colour former and the at least one colour developer, one or more sensitising agents can be present in the heat-sensitive colour-forming layer, which has the advantage that controlling the thermal print sensitivity is easier to realise.

Generally, sensitising agents that come into consideration are advantageously substances of which the melting point is between approximately 90 and approximately 150° C. and which in the molten state dissolve the colour-forming components (colour former and colour developer), without disturbing the formation of the colour complex.

Preferably the sensitising agent is a fatty acid amide, such as stearamide, behenamide or palmitamide, an ethylene-bis-fatty acid amide, such as N',N'-ethylene-bis-stearic acid amide or N,N'-ethylene-bis-oleic acid amide, a wax, such as polyethylene wax or montan wax, a carboxylic acid ester, such as dimethyl terephthalate, dibenzyl terephthalate, benzyl-p-benzyloxybenzoate, di-(p-methylbenzyl)-oxalate, di-(p-chlorobenzyl)oxalate or di-(p-benzyl)oxalate, an aromatic ether, such as 1,2-diphenoxyethane, 1,2-di-(3-methylphenoxy)ethane, 2-benzyloxynaphthalene or 1,4-diethoxynaphthalene, an aromatic sulphone, such as diphenyl sulphone, and/or an aromatic sulphonamide, such as benzenesulphonanilide or N-benzyl-p-toluenesulphonamide.

In a further preferred embodiment, in addition to the colour former, the phenol-free colour developer and the sensitising agent, at least one stabiliser (ageing-protection agent) is present in the heat-sensitive colour-forming layer.

The stabiliser is preferably sterically hindered phenols, especially preferably 1,1,3-tris-(2-methyl-4-hydroxy-5-cyclohexyl-phenyl)-butane, 1,1,3-tris-(2-methyl-4-hydroxy-5-tert-butylphenyl)-butane, 1,1-bis-(2-methyl-4-hydroxy-5-tert-butyl-phenyl)-butane.

Urea-urethane compounds of the general formula (II), commercial product UU (urea-urethane), or ethers derived from 4,4'-dihydroxydiphenyl sulphone, such as 4-benzyloxy-4'-(2-methylglycidyloxy)-diphenyl sulphone (trade name NTZ-95®, Nippon Soda Co. Ltd.), or oligomeric ethers of the general formula (III) (trade name D90®, Nippon Soda Co. Ltd.) are also suitable for use as stabilisers in the recording material according to the invention.

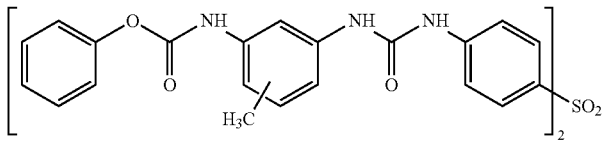

(II)

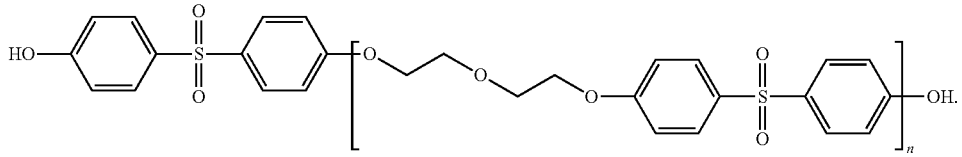

(III)

Special preference is given to the urea-urethane compounds of the general formula (II).

The stabiliser is preferably present in an amount of from 0.2 to 0.5 parts by weight, based on the at least one phenol-free colour developer of the compound of the formula (I).

In a further preferred embodiment, at least one binder is present in the heat-sensitive colour-forming layer. This is preferably water-soluble starches, starch derivatives, methylcellulose, hydroxyethylcellulose, carboxymethylcelluloses, partially or fully hydrolysed polyvinyl alcohols, chemically modified polyvinyl alcohols or styrene-maleic acid anhydride copolymers, styrene-butadiene copolymers, acryl-amide-(meth)acrylate copolymers, acrylamide-acrylate-methacrylate terpolymers, polyacrylates, poly(meth) acrylic acid esters, acrylate-butadiene copolymers, polyvinyl acetates and/or acrylonitrile-butadiene copolymers.

In a further preferred embodiment, at least one release agent (anti-stick agent) or lubricant is present in the heat-sensitive colour-forming layer. Such agents are preferably fatty acid metal salts, such as, for example, zinc stearate or calcium stearate, or behenate salts, synthetic waxes, for example in the form of fatty acid amides, such as, for example, stearic acid amide and behenic acid amide, fatty acid alkanolamides, such as, for example, stearic acid methylolamide, paraffin waxes having different melting points, ester waxes having different molecular weights, ethylene waxes, propylene waxes having different degrees of hardness and/or natural waxes, such as, for example, carnauba wax or montan wax.

In a further preferred embodiment, the heat-sensitive colour-forming layer contains pigments. The use of pigments has the advantage inter alia that they are able to fix on their surface the chemical melts formed in the thermal printing process. The surface-whiteness and opacity of the heat-sensitive colour-forming layer and the printability thereof with conventional printing inks can also be controlled by means of pigments. Finally, pigments have an "extender function", for example for the relatively expensive colour-imparting functional chemicals.

Especially suitable pigments are inorganic pigments, of both synthetic and natural origin, preferably clays, precipitated or natural calcium carbonates, aluminium oxides, aluminium hydroxides, silicic acids, diatomaceous earths, magnesium carbonates, talcum, and also organic pigments, such as hollow pigments having a styrene/acrylate copolymer wall or urea/formaldehyde condensation polymers.

To control the surface-whiteness of the heat-sensitive recording material according to the invention it is possible to incorporate optical brighteners into the heat-sensitive colour-forming layer. These are preferably stilbenes.

In order to improve certain coating-related properties it is preferred in individual cases to add further constituents, especially rheology aids, such as thickeners and/or surfactants, to the mandatory constituents of the heat-sensitive recording material according to the invention.

In a preferred embodiment, the dried heat-sensitive colour-forming layer is subjected to a smoothing step such that the Bekk smoothness is adjusted to from approximately 100 to approximately 1200 sec, especially preferably to approximately from 300 to 700 sec (measured according to DIN 53107).

The application weight of the (dry) heat-sensitive layer is preferably from approximately 1 to approximately 10 g/m$^2$, especially from approximately 3 to approximately 6 g/m$^2$.

In an especially preferred embodiment, the heat-sensitive recording material is a material according to claim 2, wherein a dye of the fluoran type is used as colour former and, in addition, a sensitising agent selected from the group consisting of fatty acid amides, aromatic sulphones and/or aromatic ethers is present. In this preferred embodiment it is also advantageous for from approximately 1.5 to approximately 4 parts by weight of the phenol-free colour developer according to claim 2, based on the colour former, to be present.

The heat-sensitive recording material according to the invention can be obtained using known production methods.

It is preferable, however, to obtain the recording material according to the invention using a method in which an aqueous suspension containing the starting materials of the heat-sensitive colour-forming layer is applied to a carrier substrate and dried, wherein the aqueous application suspension has a solids content of from approximately 20% to approximately 75% by weight, preferably from approximately 30% to approximately 50% by weight, and is applied using the curtain coating method at an operating speed of the coating apparatus of at least approximately 400 m/min and dried.

That method is especially advantageous from economic standpoints.

If the solids content falls below a value of approximately 20% by weight, efficiency is impaired because a large amount of water has to be removed from the coating in a short time by gentle drying, which has an adverse effect on the coating speed. If, on the other hand, the solids content exceeds a value of 75% by weight, this results merely in an increase in technical outlay in order to ensure the stability of the coating colour curtain during the coating process.

As mentioned above, it is advantageous to produce the heat-sensitive recording material according to the invention by means of a method in which the aqueous application suspension is applied using the curtain coating method at an operating speed of the coating apparatus of at least approximately 400 m/min. What is known as the curtain coating method is known to the person skilled in the art and is distinguished by the following criteria:

In the curtain coating method, a free-falling curtain of a coating dispersion is formed. By falling freely, the coating dispersion, which is in the form of a thin film (curtain), is "poured" onto a substrate in order to apply the coating dispersion to the substrate. DE 10196052 T1 discloses the use of the curtain coating method for the production of information recording materials including inter alia heat-sensitive recording materials, with multi-layer recording layers being obtained by application of the curtain, which consists of a plurality of coating dispersion films, to substrates (max. speed 200 m/min).

The adjustment of the operating speed of the coating apparatus to at least approximately 400 m/min has both economic and technical advantages. The operating speed is especially preferably at least approximately 750 m/min, very especially preferably at least approximately 1000 m/min and very especially preferably at least approximately 1500 m/min. It was especially surprising that even at the last-mentioned speed the heat-sensitive recording material obtained is in no way impaired and that operation proceeds in an optimum way even at such a high speed.

In a preferred embodiment of the method according to the invention, the aqueous deaerated application suspension has a viscosity of from approximately 150 to approximately 800 mPas (Brookfield, 100 rev/min, 20° C.). If the viscosity falls below a value of approximately 150 mPas or exceeds a value of approximately 800 mPas, this results in insufficient runnability of the coating composition at the coating apparatus. The viscosity of the aqueous deaerated application suspension is especially preferably from approximately 200 to approximately 500 mPas.

In a preferred embodiment, to optimise the method the surface tension of the aqueous application suspension can be adjusted to from approximately 25 to approximately 60 mN/m, preferably to from approximately 35 to approximately 50 mN/m (measured in accordance with the static ring method according to Du Noüy, DIN 53914).

The formation of the heat-sensitive colour-forming layer can be effected online or in a separate coating operation offline. This also applies to any subsequently applied layers or intermediate layers.

It is advantageous for the dried heat-sensitive colour-forming layer to be subjected to a smoothing step, it being advantageous to adjust the Bekk smoothness, measured according to DIN 53107, to from approximately 100 to approximately 1200 sec, preferably to from approximately 33 to approximately 700 sec.

The preferred embodiments listed in connection with the heat-sensitive recording material likewise apply to the method according to the invention.

The present invention relates also to a heat-sensitive recording material which is obtainable using the method described above.

The invention relates likewise to the use of the compound of the formula (I)

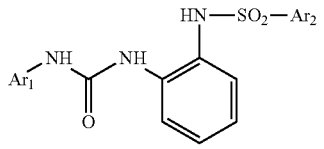

(I)

wherein $Ar_1$ and $Ar_2$ are a phenyl radical and/or a $C_1$-$C_4$alkyl-substituted phenyl radical, preferably are each a phenyl radical, as non-phenolic colour developer in a heat-sensitive recording material. As regards the preferred embodiments in respect of use, reference is made to the above preferred embodiments in respect of the heat-sensitive recording material per se.

The use according to the invention results in an improvement in the storage stability of the heat-sensitive recording material, especially storage stability at high temperatures and high ambient humidity. High temperatures are understood as being temperatures of from approximately 25 to approximately 60° C., preferably from approximately 30 to approximately 50° C. High ambient humidity is understood as being humidity of from approximately 50 to approximately 100%, preferably from approximately 70 to approximately 90%.

The advantages associated with the present invention can be summarised essentially as follows:

The present invention provides a heat-sensitive recording material which, in addition to having desirably high dynamic print sensitivity, also exhibits extraordinarily good storage stability, especially under conditions of high storage temperature and ambient humidity, without the functional properties necessary for the application, such as, for example, surface-whiteness and thermal responsiveness, being lost.

The method described above is advantageous from economic standpoints and allows the coating apparatus to operate at a high level even at a speed of more than 1500 m/min, without resulting in impairment of the product, that is to say the heat-sensitive recording material according to the invention. The procedure can be carried out online and offline, which results in a desirable degree of flexibility.

The heat-sensitive recording material according to the invention is phenol-free and is very suitable for POS (point-of-sale) and/or ticketing applications. It is also suitable for the production of travel tickets, entry tickets, lottery tickets and betting slips etc. which can be printed using direct thermal processes and ensures a high degree of stability of the images recorded thereon on prolonged storage, even under adverse climatic conditions in respect of temperature and ambient humidity, and in the event of the printed image coming into contact with hydrophobic substances, such as plasticisers, or fatty or oily substances, etc.

The invention is explained in detail below with reference to non-limited examples.

EXAMPLES

The application of an aqueous application suspension to one side of a synthetic base paper (Yupo® FP680) of 63 g/m$^2$ to form the heat-sensitive colour-forming layer of a heat-sensitive recording paper was carried out on a laboratory scale by means of a doctor bar. After drying, a thermal recording sheet was obtained. The application rate of the heat-sensitive colour-forming layer was between 4.0-4.5 g/m$^2$.

On a production scale, the application of the aqueous application suspension to a paper web having a weight per unit area of 43 g/m$^2$ was carried out by means of the curtain coating method. The viscosity of the aqueous application suspension was 450 mPas (according to Brookfield, 100 rev/min, 20° C.) (in the deaerated state). The surface tension thereof was 46 mN/m (statistical ring method). The coating apparatus was arranged inline. The curtain coating method was operated at a speed of 1550 m/min.

After the application of the aqueous application suspension, the operation of drying the coated paper carrier was carried out in the customary way. The application weight of the dry heat-sensitive layer was 4.0-4.5 g/m$^2$.

A heat-sensitive recording material or thermal paper was produced with reference to the details given above, the following formulations of aqueous application suspensions being used to form a composite structure on the carrier substrate and then the further layers, especially a protective layer, being formed in the customary way, which will not be discussed separately here.

Formulation 1

An aqueous application suspension was prepared by thoroughly mixing together an aqueous dispersion of the colour former, which was produced by grinding 20 parts by weight of 3-N-n-dibutylamine-6-methyl-7-anilinofluoran (ODB-2) with 33 parts by weight of a 15% aqueous solution of Ghosenex™ L-3266 (sulphonated polyvinyl alcohol, Nippon Ghosei) in a bead mill, an aqueous colour developer dispersion, which was produced by grinding 40 parts by weight of the colour developer together with 66 parts by weight of a 15% aqueous solution of Ghosenex™ L-3266 in the bead mill, a dispersion which was produced by grinding 40 parts by weight of sensitising agent with 33 parts by weight of a 15% aqueous solution of Ghosenex™ L-3266 in a mill, 189 parts by weight of a 56% PCC dispersion (precipitated calcium carbonate), 50 parts by weight of an aqueous 20% zinc stearate dispersion, 138 parts by weight of a 10% aqueous polyvinyl alcohol solution (Mowiol 28-99, Kuraray Europe).

The heat-sensitive coating suspensions so obtained, which can be seen in Table 1 below, were used to produce composite structures composed of paper carrier and thermal reaction layer.

TABLE 1

| Serial. No. | Specimen | Colour developer | Sensitising agent |
|---|---|---|---|
| 1 | AI | B-TUM | diphenyl sulphone |
| 2 | AII | B-TUM | stearamide |
| 3 | AIII | B-TUM | 1,2-diphenoxyethane |
| 4 | BI | TUPH | diphenyl sulphone |
| 5 | BII | TUPH | stearamide |
| 6 | BIII | TUPH | 1,2-diphenoxyethane |
| 7 | CI | phenylureido-phenyl-benzenesulphonamide | diphenyl sulphone |
| 8 | CII | phenylureido-phenyl-benzenesulphonamide | stearamide |
| 9 | CIII | phenylureido-phenyl-benzenesulphonamide | 1,2-diphenoxyethane |

TABLE 1-continued

| Serial. No. | Specimen | Colour developer | Sensitising agent |
|---|---|---|---|
| 10 | DI | PF201 | diphenyl sulphone |
| 11 | DII | PF201 | stearamide |
| 12 | DII | PF201 | 1,2-diphenoxyethane |

Formulation 2a

An aqueous application suspension was prepared by thoroughly mixing together an aqueous dispersion of the colour former, which was produced by grinding 20 parts by weight of 3-N-n-dibutylamine-6-methyl-7-anilinofluoran (ODB-2) with 33 parts by weight of a 15% aqueous solution of Ghosenex™ L-3266 in a bead mill, an aqueous colour developer dispersion, which was produced by grinding 40 parts by weight of the colour developer together with 33 parts by weight of a 15% aqueous solution of Ghosenex™ L-3266 in the bead mill, a dispersion which was produced by grinding 40 parts by weight of sensitising agent with 33 parts by weight of a 15% aqueous solution of Ghosenex™ L-3266 in a mill, 200 parts by weight of a 56% PCC dispersion (precipitated calcium carbonate), 50 parts by weight of an aqueous 20% zinc stearate dispersion, 138 parts by weight of a 10% aqueous polyvinyl alcohol solution (Mowiol 28-99).

Formulation 2b

An aqueous application suspension was prepared by thoroughly mixing together an aqueous dispersion of the colour former, which was produced by grinding 20 parts by weight of 3-N-n-dibutylamine-6-methyl-7-anilinofluoran (ODB-2) with 33 parts by weight of a 15% aqueous solution of Ghosenex™ L-3266 L-3266 in a bead mill, an aqueous colour developer dispersion, which was produced by grinding 40 parts by weight of the colour developer together with 33 parts by weight of a 15% aqueous solution of Ghosenex™ L-3266 in the bead mill, a dispersion which was produced by grinding 40 parts by weight of sensitising agent with 33 parts by weight of a 15% aqueous solution of Ghosenex™ L-3266 in a mill, a dispersion which was produced by grinding 12.5 parts by weight of ageing protector with 10 parts by weight of a 15% aqueous solution of Ghosenex™ L-3266 in a mill, 174 parts by weight of a 56% PCC dispersion (precipitated calcium carbonate), 50 parts by weight of an aqueous 20% zinc stearate dispersion, 138 parts by weight of a 10% aqueous polyvinyl alcohol solution (Mowiol 28-99). The heat-sensitive coating suspensions so obtained, which can be seen in Table 2 below, were used to produce composite structures composed of paper carrier and thermal reaction layer.

TABLE 2

| Serial No. | Specimen | Colour developer | Sensitising agent | Ageing protector** |
|---|---|---|---|---|
| 13 | EI-a | PF201 | 2-benzyloxynaphthalene | — |
| 14 | EI-b | | | DH-43 |
| 15 | EII-a | | 1,2-di-(3-methyl- | — |
| 16 | EII-b | | phenoxy)ethane | DH-43 |
| 17 | EIII-a | | 2-benzyloxynaphthalene: | — |
| 18 | EIII-b | | steramide* | DH-43 |
| 19 | FI-a | phenyureido-phenyl- | 2-benzyloxynaphthalene | — |
| 20 | FI-b | benzenesulphonamide | | DH-43 |
| 21 | FII-a | | 1,2-di-(3-methyl- | — |
| 22 | FII-b | | phenoxy)ethane | DH-43 |
| 23 | FIII-a | | 2-benzyloxynaphthalene: | — |
| 24 | FIII-b | | steramide* | DH-43 |

*ratio by weight 1:1

**DH-43: 1,1,3-tris-(2-methyl-4-hydroxy-5-cyclohexyl-phenyl)-butane

The particle size ($D_{4.3}$ value in μm) of the ground functional chemicals was adjusted in accordance with Table 3 (±0.1 μm).

TABLE 3

| | Colour former (μm) | Colour developer (μm) | Sensitising agent (μm) |
|---|---|---|---|
| Grinding~~Coating~~ series 1 | 1.0 | 0.5 | 1.0 |
| Grinding~~Coating~~ series 2 | 1.0 | 1.0 | 1.0 |

The measurement of the particle size distribution was effected by laser diffraction using a Coulter LS230 apparatus from Beckman Coulter.

The thermal recording materials according to Tables 1, 2 and 3 were analysed as follows.

Paper whiteness on the coating side was determined in accordance with DIN/ISO 2470 using an Elrepho 3000 spectral photometer.

Dynamic colour density:

The papers (6 cm wide strips) were printed thermally using the Atlantek 200 test printer (Atlantek, USA) with a Kyocera printhead of 200 dpi and 560 Ohm at an applied voltage of 20.6 V and a maximum pulse width of 0.8 ms with a chequered pattern with 10 energy stages. The image density (optical density, o.d.) was measured using a Macbeth densitometer RD-914 from Gretag.

(3) Storage stability of the unprinted material:

A sheet of recording paper is cut into three identical strips. One strip is dynamically recorded in accordance with the method of (2) and the image density is determined. The two other strips, in the unprinted (white) state, are exposed to a climate of 40° C. and 85% relative humidity (climate 1) and a climate of 60° C. and 50% relative humidity (climate 2), respectively, for 4 weeks. After climate conditioning of the papers they are dynamically printed in accordance with the method of (2) and the image density is determined using the densitometer. The % change in the writing performance on printing of the stored specimens was calculated in accordance with the following equation (I).

$$\%\ \text{change in writing performance} = \left(\frac{\text{image density after storage}}{\text{image density before storage}} - 1\right) * 100 \quad \text{(I)}$$

(4) Plasticiser stability of the printed image:

A plasticiser-containing clingfilm (PVC film with 20-25% dioctyl adipate) was brought into contact with the sample of the thermal recording paper, which had been dynamically recorded in accordance with the method of (2), avoiding folds and inclusions of air, then rolled up into a roll and stored for 16 hours at room temperature (20-22° C.). After removal of the film, the image density (o.d.) was measured and, in accordance with equation (II), set in relation to the corresponding image density values before the action of the plasticiser.

$$\%\ \text{change in optical density} = \left(\frac{\text{image density after plasticiser}}{\text{image density before plasticiser}} - 1\right) * 100 \quad \text{(II)}$$

(5) Quantification of the coating components (colour former and colour developer) is effected after HPLC separation using a series 1200 HPLC apparatus from Agilent having a DAD detector.

Sample preparation: 2 circular areas are cut out from the paper specimen using a punch and weighed. The paper samples are extracted with 3 ml of acetonitrile (HPLC quality) in an ultrasonic bath for 30 minutes and the extract is filtered through a PTFE syringe filter (0.45 μm).

HPLC separation of the ingredients: using an autosampler the above extract was applied to a separating column (Zorbax Eclipse XDB-C18) and eluted using the eluant acetonitrile:THF:$H_2O$ (450:89:200 parts by weight) with an acetonitrile gradient. Quantitative analysis of the chromatograms is carried out by comparing the areas of the sample peaks assigned by means of tR times with a calibration curve determined by means of the reference specimens. The measurement error in the HPLC quantification is ±2%.

Table 4 summarises the analysis of the papers corresponding to formulation 1 (Table 1), grinding series 1; Table 5 summarises the analysis of the papers corresponding to formulation 1 (Table 1), grinding series 2; and Table 6 summarises the analysis of the papers corresponding to formulation 2a and 2b (Table 3), grinding series 2.

The maximum achieved image densities (o.d. max) of the fresh papers are compared with the corresponding values after printing of the stored papers under two climate conditions:

Climate 1: storage of the unprinted papers for 4 weeks at 40° C. and 85% relative humidity Climate 2: storage of the unprinted papers for 4 weeks at 60° C. and 50% relative humidity For selected papers, quantitative determination of the colour developer in the fresh and stored papers was also carried out and, as control, corresponding determination of the colour former as coating component, which, according to experience, undergoes virtually no change over the storage period.

The values of the plasticiser test (P-test) quantify the durability of the printed image under the influence of dioctyl adipate (representing hydrophobic agents) with reference to the % change in the maximum writing performance (o.d. max) during the test.

Changes in the o.d. of ≤10% are tolerable and do not impair the usability of the papers.

TABLE 4

| Test parameter | | AI-1* | AII-1 | AIII-1 | BI-1 | BII-1 | BIII-1 | CI-1 | CII-1 | CIII-1 | DI-1 | DII-1 | DIII-1 |
|---|---|---|---|---|---|---|---|---|---|---|---|---|---|
| Paper whiteness | fresh | 82.2 | 85.2 | 83.5 | 86.2 | 85.7 | 87.4 | 86.4 | 86.1 | 87.4 | 86.2 | 85.5 | 81.6 |
| (%) | 4 wks (climate 1) | 83.4 | 84.8 | 85.0 | 86.6 | 86.6 | 86.5 | 86.1 | 86.2 | 85.1 | 66.0 | 63.6 | 66.4 |
| | % change | 1 | 0 | 2 | 0 | 1 | −1 | 0 | 0 | −3 | −23 | −26 | −19 |
| o.d. max. | fresh | 1.20 | 1.13 | 1.18 | 1.28 | 1.18 | 1.31 | 1.27 | 1.24 | 1.30 | 1.27 | 1.24 | 1.28 |
| | 4 wks (climate 1) | 0.68 | 0.74 | 0.51 | 0.48 | 0.57 | 0.40 | 1.29 | 1.25 | 1.30 | 0.89 | 0.87 | 0.91 |
| | % change | −43 | −35 | −57 | −63 | −52 | −69 | +2 | +1 | 0 | −30 | −30 | −29 |
| | 4 wks (climate 2) | 0.63 | 0.90 | 0.65 | 0.30 | 0.52 | 0.28 | 1.16 | 1.23 | 1.20 | 0.74 | 0.80 | 0.90 |
| | % change | −48 | −20 | −45 | −77 | −56 | −79 | −9 | −1 | −8 | −42 | −35 | −30 |

TABLE 4-continued

| Test parameter | | AI-1* | AII-1 | AIII-1 | BI-1 | BII-1 | BIII-1 | CI-1 | CII-1 | CIII-1 | DI-1 | DII-1 | DIII-1 |
|---|---|---|---|---|---|---|---|---|---|---|---|---|---|
| CD (mg/m$^2$) | fresh | — | — | 548 | — | — | 507 | — | — | 568 | — | — | 647 |
| | 4 wks (climate 1) | — | — | 303 | — | — | 382 | — | — | 563 | — | — | 590 |
| | % change | — | — | −45 | — | — | −25 | — | — | −1 | — | — | −9 |
| | 4 wks (climate 2) | — | — | 475 | — | — | 242 | — | — | 550 | — | — | 436 |
| | % change | — | — | −13 | — | — | −52 | — | — | −3 | — | — | −33 |
| CF (mg/m$^2$) | fresh | — | — | 294 | — | — | 296 | — | — | 284 | — | — | 292 |
| | 4 wks (climate 1) | — | — | 288 | — | — | 293 | — | — | 287 | — | — | 294 |
| | % change | — | — | −2 | — | — | −1 | — | — | 1 | — | — | 1 |
| | 4 wks (climate 2) | — | — | 292 | — | — | 294 | — | — | 281 | — | — | 277 |
| | % change | — | — | −1 | — | — | −1 | — | — | −1 | — | — | −5 |
| P-test | fresh | 1.18 | 1.05 | 1.17 | 1.26 | 1.12 | 1.33 | 1.25 | 1.25 | 1.30 | 1.27 | 1.24 | 1.26 |
| | 16 h test | 1.15 | 1.09 | 1.13 | 1.11 | 1.02 | 1.20 | 1.17 | 1.17 | 1.24 | 1.24 | 1.21 | 1.19 |
| | % change | −3 | 4 | −3 | −12 | −9 | −10 | −6 | −6 | −5 | −2 | −2 | −6 |

CD: colour developer,
CF: colour former
*AI-1 = formulation AI (Table 1), grinding series 1 (Table 3)

TABLE 5

| Test parameter | Mod. | AI-2 | AII-2 | AIII-2 | BI-2 | BII-2 | BIII-2 | CI-2 | CII-2 | CIII-2 | DI-2 | DII-2 | DIII-2 |
|---|---|---|---|---|---|---|---|---|---|---|---|---|---|
| Paper | fresh | 85.7 | 85.7 | 83.8 | 85.7 | 85.4 | 87.0 | 86.7 | 86.4 | 87.3 | 86.1 | 85.4 | 87.0 |
| whiteness | 4 wks (climate 1) | 85.2 | 85.5 | 85.0 | 86.3 | 86.1 | 85.9 | 86.5 | 86.4 | 85.1 | 64.9 | 67.4 | 70.9 |
| (%) | % change | −1 | 0 | 1 | 1 | 1 | −1 | 0 | 0 | −3 | −25 | −21 | −19 |
| o.d. max. | fresh | 1.17 | 1.09 | 1.18 | 1.29 | 1.22 | 1.29 | 1.30 | 1.26 | 1.29 | 1.25 | 1.21 | 1.28 |
| | 4 wks (climate 1) | 0.86 | 0.81 | 0.51 | 0.47 | 0.65 | 0.50 | 1.32 | 1.26 | 1.28 | 0.93 | 0.82 | 0.91 |
| | % change | −26 | −26 | −57 | −64 | −47 | −61 | +2 | 0 | −1 | −26 | −32 | −29 |
| | 4 wks (climate 2) | 0.67 | 0.96 | 0.65 | 0.31 | 0.65 | 0.31 | 1.17 | 1.24 | 1.20 | 0.88 | 0.76 | 0.55 |
| | % change | −43 | −12 | −45 | −76 | −47 | −76 | −10 | −2 | −7 | −30 | −37 | −57 |
| CD (mg/m$^2$) | fresh | — | — | 478 | — | — | 455 | — | — | 607 | — | — | 653 |
| | 4 wks (climate 1) | — | — | 357 | — | — | 300 | — | — | 577 | — | — | 687 |
| | % change | — | — | −25 | — | — | −34 | — | — | −5 | — | — | −10 |
| | 4 wks (climate 2) | — | — | 442 | — | — | 222 | — | — | 562 | — | — | 438 |
| | % change | — | — | −8 | — | — | −51 | — | — | −7 | — | — | −33 |
| CF (mg/m$^2$) | fresh | — | — | 277 | — | — | 291 | — | — | 288 | — | — | 293 |
| | 4 wks (climate 1) | — | — | 300 | — | — | 280 | — | — | 284 | — | — | 291 |
| | % change | — | — | +8 | — | — | −4 | — | — | −1 | — | — | −1 |
| | 4 wks (climate 2) | — | — | 280 | — | — | 283 | — | — | 266 | — | — | 278 |
| | % change | — | — | +1 | — | — | −3 | — | — | −8 | — | — | −5 |
| P-test | fresh | 1.16 | 1.08 | 1.11 | 1.27 | 1.17 | 1.27 | 1.30 | 1.25 | 1.30 | 1.26 | 1.23 | 1.29 |
| | 16 h test | 1.13 | 1.10 | 1.10 | 1.09 | 1.09 | 1.13 | 1.23 | 1.19 | 1.25 | 1.26 | 1.22 | 1.24 |
| | % change | −3 | 2 | −1 | −14 | −7 | −11 | −5 | −5 | −4 | 0 | −1 | −4 |

CD: colour developer,
CF: colour former

TABLE 6

| Test parameter | Specimen | EI-a | EI-b | EII-a | EII-b | EIII-a | EIII-b | FI-a | FI-b | FII-a | FII-b | FIII-a | FIII-b |
|---|---|---|---|---|---|---|---|---|---|---|---|---|---|
| o.d. max. | fresh | 1.24 | 1.24 | 1.25 | 1.30 | 1.32 | 1.25 | 1.33 | 1.26 | 1.26 | 1.30 | 1.29 | 1.29 |
| | 4 wks (climate 2) | 0.81 | 0.86 | 0.78 | 1.03 | 0.77 | 0.92 | 1.16 | 1.14 | 1.15 | 1.21 | 1.23 | 1.22 |
| | % change | −35 | −31 | −38 | −21 | −42 | −26 | −8 | −5 | −9 | −7 | −5 | −5 |
| CD (mg/m$^2$) | fresh | 536 | 546 | 556 | 685 | 596 | 584 | 672 | 680 | 621 | 613 | 599 | 615 |
| | 4 wks (climate 2) | 398 | 430 | 403 | 546 | 380 | 376 | 685 | 666 | 608 | 605 | 583 | 605 |
| | % change | −26 | −21 | −28 | −20 | −36 | −36 | 2 | −2 | −2 | −1 | −3 | −2 |
| CF (mg/m$^2$) | fresh | 300 | 299 | 328 | 318 | 328 | 313 | 324 | 326 | 296 | 309 | 303 | 302 |
| | 4 wks (climate 2) | 295 | 298 | 310 | 319 | 313 | 296 | 328 | 316 | 290 | 307 | 297 | 296 |
| | % change | −2 | 0 | −5 | 0 | −5 | −5 | 1 | −3 | −2 | −1 | −2 | −2 |

CD: colour developer,
CF: colour former

The heat-sensitive recording material of the present invention exhibits especially the following advantageous properties:

(1) The heat-sensitive recording material according to the invention exhibits virtually the same writing performance before and after four weeks' storage in the unprinted state under two different storage conditions. The fall in the maximum print density in all papers having the colour developer according to the invention is ≤10% of the print density of the fresh papers (CI-1, CII-1, CIII-1, CI-2, CII-2, CIII-2, FI-1, FI-2, FII-1, FII-2, FIII-1, FIII-2).

In comparison, the comparison materials AI-1, AII-1, AIII-1, BI-1, BII-1, BIII-1, DI-1, DII-1, DIII-1, EI-1, EI-2, EII-1, EII-2, EIII-1, EIII-2, exhibit marked losses in writing performance.

(2) The decrease in colour developer concentration in the heat-sensitive colour-forming layer is minimal for the colour former according to the invention (≤7%) and hardly impairs the writing performance. In contrast, the use of known non-phenolic developers leads to significant losses in the amount of colour developer in the paper and in an unacceptable low writing performance after storage.

(3) The recorded image of the heat-sensitive papers according to the invention having the colour developer according to the invention has a maximum print density that is in no way inferior to the developers of the comparison specimens (fresh max. o.d. values from Tables 4, 5, 6), is stable and, after the action of plasticisers, barely fades, comparable to the performance of the known non-phenolic comparison developers (P-test line, Tables 4 and 5).

(4) Using typical ageing-protection agents, the storage stability of the papers cannot be improved or exhibits only an inadequate improvement (E-a series versus E-b, Table 6).

(5) The surface-whiteness of the recording papers according to the invention is stable and, after the storage tests, exhibits good values comparable to those of the best comparison papers and considerably better values than those based on the Pergafast 201® developer that is widely used in practice (D-series, Tables 4 and 5).

(6) Using the production method according to the invention, a heat-sensitive recording material exhibiting high quality in all important use-related aspects can be produced under economically advantageous conditions.

The invention claimed is:

1. Heat-sensitive recording material, comprising a carrier substrate and also a heat-sensitive colour-forming layer containing at least one colour former, at least one phenol-free colour developer and at least one sensitising agent, characterised in that the at least one colour developer is a compound of the formula (I)

(I)

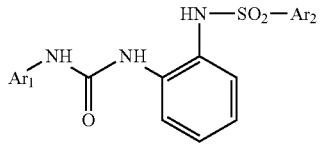

wherein $Ar_1$ and $Ar_2$ are a phenyl radical and/or a $C_1$-$C_4$alkyl-substituted phenyl radical wherein the at least one sensitising agent is 1,2-Diphenoxyethane and wherein the dried heat-sensitive colour-forming layer is subjected to a smoothing step such that the Bekk smoothness is adjusted to from 300 to 700 sec (measured according to DIN 53107).

2. Heat-sensitive recording material according to claim 1, characterised in that $Ar_1$ and $Ar_2$ are each a phenyl radical.

3. Heat-sensitive recording material according to claim 1, characterised in that the carrier substrate is paper, synthetic paper and/or a plastics film.

4. Heat-sensitive recording material according to claim 1, characterised in that the at least one colour former is a dye of the triphenylmethane type, of the fluoran type, of the azaphthalide type and/or of the fluorene type.

5. Heat-sensitive recording material according to claim 4, characterised in that the dye of the fluoran type is selected from the group consisting of 3-diethylamino-6-methyl-7-anilinofluoran,
3-(N-ethyl-N-p-toludinamino)-6-methyl-7-anilinofluoran,
3-(N-ethyl-N-isoamylamino)-6-methyl-7-anilinofluoran,
3-diethylamino-6-methyl-7-(o,p-dimethylanilino)fluoran,
3-pyrrolidino-6-methyl-7-anilinofluoran,
3-(cyclohexyl-N-methylamino)-6-methyl-7-anilinofluoran,
3-diethylamine-7-(m-trifluoromethylanilino)fluoran,
3-N-n-dibutylamine-6-methyl-7-anilinofluoran,
3-diethylamino-6-methyl-7-(m-methylanilino)fluoran,
3-N-n-dibutylamine-7-(o-chloroanilino)fluoran,
3-(N-ethyl-N-tetrahydrofurfurylamine)-6-methyl-7-anilinofluoran,
3-(N-ethyl-N-propylamine)-6-methyl-7-anilinofluoran,
3-(N-ethyl-N-ethoxypropylamine)-6-methyl-7-anilinofluoran,
3-(N-ethyl-N-isobutylamine)-6-methyl-7-anilinofluoran and/or
3-dipentylamine-6-methyl-7-anilinofluoran.

6. Heat-sensitive recording material according to claim 1, further comprising, in addition to the compound of the formula (I), one or more further non-phenolic colour developers, selected from the group of sulphonylureas, consisting of N'-(p-toluenesulphonyl)-N'-phenylurea,N-(p-toluenesulphonyl)-N'-3-(p-toluenesulphonyloxyphenyl)-urea and/or 4,4'-bis-(p-tolylsulphonylureido)-diphenylmethane.

7. Heat-sensitive recording material according to claim 1, characterised in that from approximately 0.5 to approximately 10 parts by weight, of the compound of the formula (I), based on the colour former, are present.

8. Heat-sensitive recording material according to claim 1, characterised in that the compound of the formula (I) is present in an amount of from approximately 3 to approximately 35% by weight, based on the total solids content of the heat-sensitive layer.

9. Heat-sensitive recording material according to claim 1, characterised in that the heat-sensitive colour-forming layer contains additives comprising one or more of stabilisers, binders, release agents, pigments and brighteners.

10. Heat-sensitive recording material according to claim 1, characterised in that the application weight of the (dry) heat-sensitive layer is from approximately 1 to approximately 10 $g/m^2$.

11. Heat-sensitive recording material according to claim 1, characterised in that the heat-sensitive colour-forming layer contains a urea-urethane compound of the general formula (II)

(II)

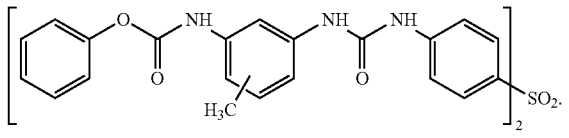

12. Method of producing a heat-sensitive recording material according to claim 1, characterised in that an aqueous suspension containing the starting materials of the heat-sensitive colour-forming layer is applied to a carrier substrate and dried, wherein the aqueous application suspension has a solids content of from approximately 20% to approximately 75% by weight, and is applied using a curtain coating method and apparatus at an operating speed of the coating apparatus of at least approximately 400 m/min and dried.

13. Heat-sensitive recording material according to claim 1, characterised in that the at least one colour former is a dye of the fluoran type.

14. Heat-sensitive recording material according to claim 1 characterised in that from approximately 1.5 to approximately 4 parts by weight of the compound of the formula (I), based on the colour former, are present.

15. Heat-sensitive recording material according to claim 1 characterised in that the compound of the formula (I) is present in an amount of from approximately 10 to approximately 25% by weight based on the total solids content of the heat-sensitive layer.

16. Heat-sensitive recording material according to claim 1 characterised in that the application weight of the (dry) heat-sensitive layer is from approximately 3 to approximately 6 $g/m^2$.

17. Method of producing a heat-sensitive recording material according to claim 1 characterised in that an aqueous suspension containing the starting materials of the heat-sensitive colour-forming layer is applied to a carrier substrate and dried, wherein the aqueous application suspension has a solids content of from approximately 30% to approximately 50% by weight, and is applied using a curtain coating method and apparatus at an operating speed of the coating apparatus of at least approximately 400 m/min and dried.

18. Method of producing a heat-sensitive recording material according to claim 1 characterised in that an aqueous suspension containing the starting materials of the heat-sensitive colour-forming layer is applied to a carrier substrate and dried, wherein the aqueous application suspension has a solids content of from approximately 20% to approximately 75% by weight, and is applied using a curtain coating method and apparatus at an operating speed of the coating apparatus of at least approximately 1000 m/min and dried.

19. Method of producing a heat-sensitive recording material according to claim 1 characterised in that an aqueous suspension containing the starting materials of the heat-sensitive colour-forming layer is applied to a carrier substrate and dried, wherein the aqueous application suspension has a solids content of from approximately 20% to approximately 75% by weight, and is applied using a curtain coating method and apparatus at an operating speed of the coating apparatus of at least approximately 1500 m/min and dried.

20. Method of producing a heat-sensitive recording material according to claim 1 characterised in that an aqueous suspension containing the starting materials of the heat-sensitive colour-forming layer is applied to a carrier substrate and dried, wherein the aqueous application suspension has a solids content of from approximately 30% to approximately 50% by weight, and is applied using a curtain coating method and apparatus at an operating speed of the coating apparatus of at least approximately 1000 m/min and dried.

* * * * *